US005220938A

United States Patent [19]

Kley

[11] Patent Number: 5,220,938

[45] Date of Patent: Jun. 22, 1993

[54] FLUID FLOW FRICTION REDUCTION SYSTEM

[76] Inventor: Vic Kley, 1119 Park Hill Rd., Berkeley, Calif. 94708

[21] Appl. No.: 868,296

[22] Filed: Apr. 14, 1992

[51] Int. Cl.[5] ..... F17D 1/16

[52] U.S. Cl. ..... 137/88; 137/13; 137/93; 137/236.1

[58] Field of Search ..... 137/88, 89, 90, 91, 137/92, 93, 4, 13, 236.1

[56] References Cited

U.S. PATENT DOCUMENTS

| | | | |
|---|---|---|---|
| 3,601,079 | 8/1971 | Giles | 137/13 X |
| 3,820,557 | 6/1974 | Wartman | 137/13 X |
| 3,900,043 | 8/1975 | Bowen et al. | 137/236.1 X |
| 4,397,748 | 8/1983 | Argabright et al. | 137/13 X |
| 4,420,008 | 12/1983 | Shu | 137/92 X |
| 4,842,486 | 6/1989 | Neubauer | 137/13 X |
| 4,958,653 | 9/1990 | Lowther | 137/13 |
| 4,982,756 | 1/1991 | Scribner | 137/92 X |
| 4,991,614 | 2/1991 | Hammel | 137/571 X |

OTHER PUBLICATIONS

K. N. Liu et al., "Drag reduction in pipes lined riblets," AATA Journal 28, 1697-8 (Oct. 1990).

"Polymers and Riblets Reduce Hydrodynamic Skin Friction," Nasa Tech Briefs, 77-78 (Oct. 1991).

J. Hoyt, "Drag Reduction," Encyclopedia of Polymer Science and Engineering, vol. 5, 2d Edition, pp. 129-151, Wiley & Sons (1986).

*Primary Examiner*—Stephen M. Hepperle

*Attorney, Agent, or Firm*—David J. Larwood

[57] ABSTRACT

This invention further provides an improved system of fluid transport, including a fluid source and a fluid transport connected to the source. The system includes means for monitoring the concentration of a friction reducing material in the system and means for adding friction reducing material to the fluid transport when the fluid transport could handle a greater throughput, i.e. there is an excess of fluid available at the fluid source and the throughput in the fluid transport limits the amount of fluid which can be transported through the system.

19 Claims, 2 Drawing Sheets

FLUID FLOW FRICTION REDUCTION SYSTEM

FIELD OF THE INVENTION

The present invention relates to an apparatus and method which permits increased fluid flow and decreased energy use in transporting fluids through pipelines and other confined turbulent flow systems.

It is particularly important in regions where drought or seasonal conditions or limited infrastructure (existing pipeline capacity) limit available water supplies.

BACKGROUND OF THE INVENTION

Throughout the world and particularly in the western United States there are regions in which seasonal water runoff is lost to storage because pipelines to transport the water flows to storage areas have only limited carrying capacity. The carrying capacity of a pipe depends on the diameter of the pipe, friction within the pipe, and other factors. The flow resistance of a pipe increases rapidly when the flow rate increases above onset of turbulent flow. During periods of moderate flow, the pipelines can transport the available water. During periods of heavy flow, however, pipelines cannot carry all of the water available. In addition, turbulence induced friction losses can consume significant unnecessary energy costs annually.

Since the early 1970's it has been know that certain materials when added to fluids in turbulent flow can substantially reduce friction. This friction reduction results in substantial increases in the capacity of the pipe (typically 30%) and reduction in the energy required to transport the fluid. There are a variety of suitable materials available, including polyacrylamides (either nonionic or partially anionic), polyoxyethylene glycol, xanthans, guar, carrageenan, and oil-soluble polymers.

At present such materials are expensive and therefore limited to the transport of valuable fluids such as oil, for example the Trans-Alaska Pipeline. Known materials cannot be added to water supplies, not only for cost reasons but also because such materials would make water unfit for consumption.

One method known for reducing turbulent flow on a surface that is in contact with a flowing fluid is to create small ridges or riblets on the surface. See K. N. Liu et al., "Drag reduction in pipes lined riblets," AATA Journal 28, 1697–8 (Oct. 1990). These discussions are very different from the present invention. In addition, some preliminary work has been done injecting long-chain polymer molecules into riblet grooves on a boat hull, generally aligned with the direction of travel of the boat. "Polymers and Riblets Reduce Hydrodynamic Skin Friction," Nasa Tech Briefs, 77–78 (Oct. 1991).

SUMMARY OF THE INVENTION

This invention provides a friction reducing material suitable for reducing friction in a flowing fluid, where the material has a ratio of length to width in excess of 25 whereby the fluid can flow with reduced friction in a turbulent flow condition.

This invention further provides an improved system of fluid transport, including a fluid source, a fluid reservoir, a fluid transport connecting the source and the reservoir, and an outlet of the reservoir, the improvement. The system includes means for monitoring the concentration of a friction reducing material in the reservoir and means for maintaining the concentration below a preselected maximum, means for monitoring the concentration of the friction reducing material in the fluid transport and maintaining the concentration below a preselected maximum, means for monitoring the concentration of the friction reducing material at the outlet of the reservoir and maintaining the concentration below a preselected maximum, and means for adding friction reducing material to the fluid transport when the reservoir is less than full and the fluid transport could handle a greater throughput, i.e. there is an excess of fluid available at the fluid source and the throughput in the fluid transport limits the amount of fluid which can be transported from the source to the reservoir.

This invention also includes a pipe liner combining a pipe with an interior wall with a liner separated from interior wall by a small space filled with essentially the same material as in the middle of the pipe. The pipe liner can be fitted with a plurality of holes which can allow friction reducing material between the interior wall and the liner to leak into the central portion of the pipe, within the liner.

It is one object of this invention to provide a material suitable for reducing turbulent flow in a pipe.

It is a further object of this invention to provide such a material which can be added to drinking water and later reduced in concentration, with the remaining amount safe for potable water.

It is still a further object of this invention to provide a system of adding, monitoring and partially removing such a material from a water system.

It is yet another object of this invention to provide a liner for pipes that includes riblets for reducing friction.

It is yet another object of this invention combine a liner for pipes with a system for using a friction reducing material.

DETAILED DESCRIPTION OF THE INVENTION

The preferred form of the present invention includes several disparate elements, each of which have unique applications in this invention. They include a novel class of friction reducing materials, a system of monitoring fluid flows and injecting friction reducing material, and finally a system of lining a pipe with a series of horizontal riblets, with or without injection of friction reducing material. The method of this invention is most useful for adding friction reducing material at choke-points in a water distribution system.

The friction reducing material may be a molecule, an aggregate of molecules, fiber or other structure that has the general characteristics of being generally long, with a ratio of length:width in excess of 25. The width may have dimensions of a few Ångstroms to several millimeters. In a preferred form of the invention, the friction reducing material is partially hydrolyzed polyacrylamide (PHPA) in water. PHPA has been approved by the Environmental Protection Agency for use in drinking water at concentrations up to 4 ppm. This molecule can be prepared according to well-known methods. See Example 1, below. This molecule, in preferred forms, has a width of less than 20 Ångstroms, and a length of about 50 microns, a ratio of about 18,000,000. When present in water at concentrations above about 30 ppm, PHPA significantly reduces turbulence, allowing increased fluid throughput in a pipe. Other useful friction reducing materials include guar gum and carrageenan, both well known materials. These materials are generally linear, but with a much smaller ratio of length to width, in excess of 500. The preferred concentration of these materials is above about 100–200 ppm. Still other useful friction reducing materials include wood fibers, with a ratio of length to width in excess of 25.

Rainfall collects naturally in streams and rivers which channel water towards the ocean. In addition, considerable rainwater soaks into the earth as part of underground aquifers. Society finds it beneficial to collect significant portions of this rainfall and channel it and store it for use at a later time or in a different area. The California water project is one example of redistributing water. In addition, in some cases these may be too much water stored in a system and it may be necessary to move large volumes of water out of a reservoir, even emptying a reservoir, or sewer or flood control system, to accomodate new input.

Figure 1:
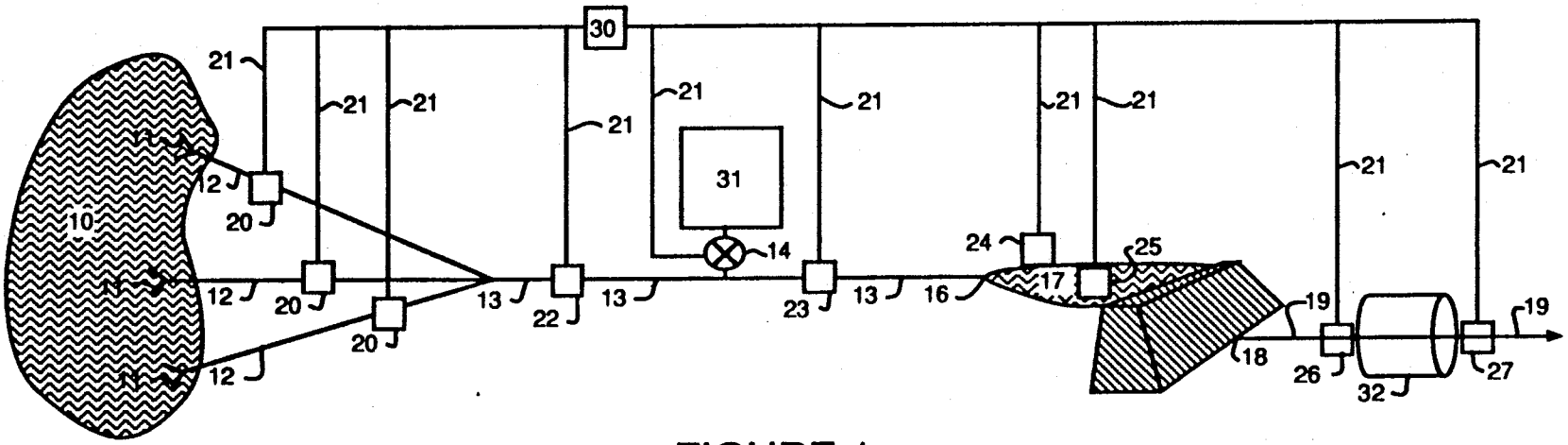
FIG. 1 illustrates a water transport system and the system of this invention.

Referring to FIG. 1, pipe intakes 11 introduce water from source 10 to collection pipes 12. Collection pipes 12 each feed transport pipe 13 which transports water through inlet 16 to reservoir 17. Reservoir 17 might be a tank, a dam or a lake. Outlet pipe 19 is connected to reservoir 17 starting at exit 18 to carry the outflow to some downstream destination such as a city or a building (not shown). A typical reservoir 17 would have additional sources 10, intakes 11, collection pipes 12 and transport pipes 13 bringing water to it (not shown).

Sensors through the system measure various parameters. The water flow in collection pipes 12 is measured by sensors 20 and the sensed information is communicated over wires 21 to computer 30. The water flow and concentrations of selected materials at selected locations along transport pipe 13 are measured by sensors 22 and 23, also connected to computer 30 through wire 21. Various parameters are detected by sensors 24 and 25 at various locations in reservoir 17 and by sensors 26 and 27 along outlet pipe 19. Each of these sensors are connected through wire 21 to computer 30.

This allows comparison of sensed information at various sites, as well as tracking of parameters over time. The information in one distribution system may be useful for the administration of a second water system as well, thus administrators of different water systems may choose to share information.

Wires 21 may consist in whole or in part of any of several means of carrying information, including one or more wires, fiberoptic media, radio, satellite or cellular link, or other means known in the art. Computer 30 may be any of a number of devices known in the art, including one or more computers in one or more locations, one or more computer networks or a distributed computing environment.

The system of this invention also consists of a supply 31 of friction reducing material connected through valve 14 to transport pipe 13. Sensors, e.g. 22 and 23, detect the concentration of friction reducing material in some portion of the system, e.g. transport pipe 13.

The system can include deconcentrator 32 in outlet pipe 19 which acts on the friction reducing material to reduce its concentration in the output flow.

The system operates by monitoring the status of reservoir 17, including the level of water in the reservoir and the concentration of friction reducing material at various points in reservoir 17.

If there is a sufficient flow of water through collecting pipes 12 and reservoir 17 is not at full capacity, then transport pipe 13 may be at its maximum carrying capacity. Computer 30 can operate valve 14 to release friction reducing material from supply 31 at a rate sufficient to give the desired concentration of friction reducing material in transport pipe 13. Sensor 23 can aid in creating a tight feedback loop so computer 30 can accurately control that concentration.

The concentration or rate of addition of friction reducing material can be controlled automatically by computer 30 but the rate can also be manually controlled. In addition, computer 30 can be fitted with various override controls that would modify the standard rate of addition in compliance with directives or goals from a programmer or system administrator.

It is desireable to add only the amount of friction reducing material required to optimize water transport through transport pipe 13 and no more. For PHPA, a concentration above about 4 or 5 ppm is effective in reducing friction during turbulent flow. The friction reduction increases with increasing PHPA concentration, with a maximum effect at about 30 ppm. The maximum effect is maintained at higher PHPA concentrations. However, the concentration of friction reducing material in outflow pipe 19 should not exceed the EPA-approved limit of 4 ppm. One way to control that concentration is to use controlled injections of friction reducing material. The friction reducing material in reservoir 17 will be diluted if the concentration in the reservoir is less than the concentration in transport pipe 13. Sensors 24 and 25 and other (not shown) in reservoir 17 can report local concentrations of friction reducing material and when concentrations in reservoir 17 are too great, further injections of friction reducing material can be cut back.

Another method of limiting the maximum concentration of friction reducing material in reservoir 17 is by releasing friction reducing material at valve 14 in impulses, thereby attaining periodic high concentrations, and consequent high water throughput, and intervening lower concentrations.

One method of reducing the concentration of friction reducing material in outlet pipe 19 is by removing or changing friction reducing material at deconcentrator 32. Several methods of deconcentration are possible, depending on the specific friction reducing material in use. For example, for PHPA, a shearing mill can reduce the length of molecular change, changing the character of PHPA and reducing its potential toxicity, making PHPA fragments amenable to removal by other methods. The turbine pumps commonly used in the water industry can perform this shearing function during normal operation. Other methods of deconcentration include flocculation, coagulation, centrifugation or other gravity separation, and precipitation, using methods known by those skilled in the art.

Other methods can be adapted to modified or other friction reducing materials. For example, PHPA may be modified by including certain photolysable functionalities in the molecule. Deconcentrator 32 could include photo treatment to reduce modified PHPA to smaller fragments. Still other methods of deconcentration include using a bioactive material such as a modified yeast to consume the friction reducing material.

Figure 2A:
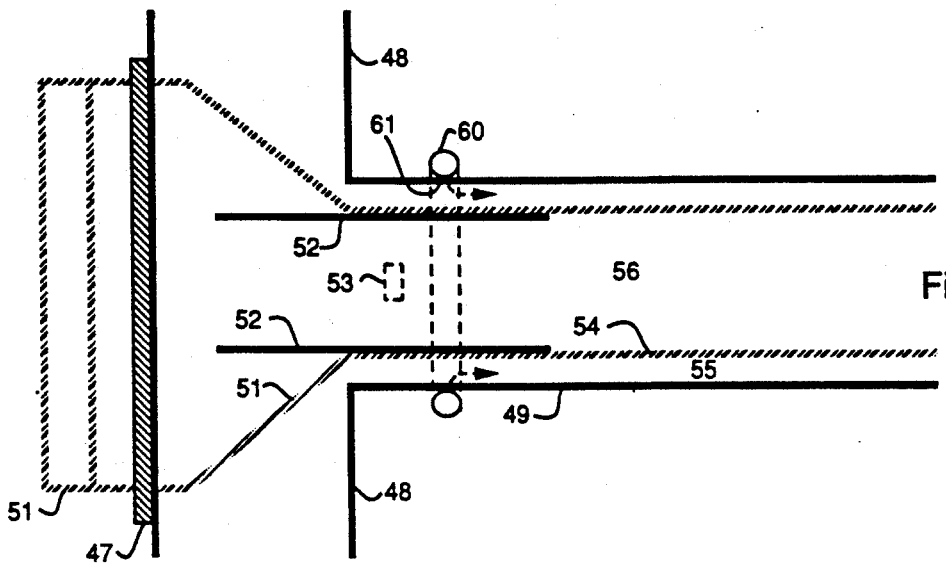
FIGS. 2A, 2B and 2C illustrate a pipe fitted with the liner of this invention.
Figure 2B:
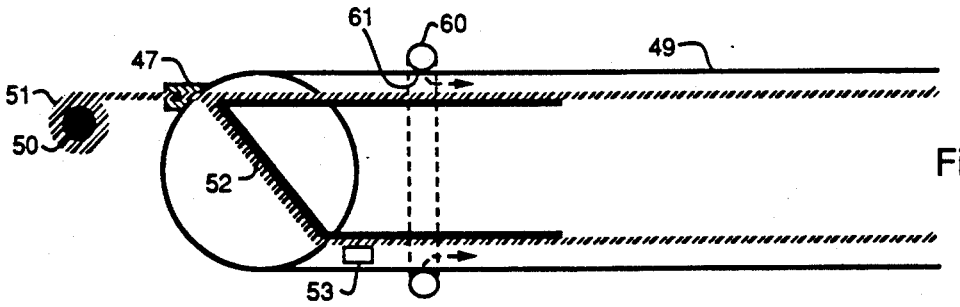
Figure 2C:
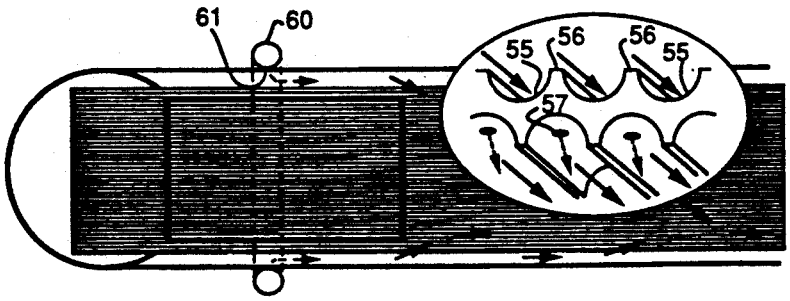

Another method of reducing turbulent flow is to reduce the friction along the side walls of a pipe. Referring to FIG. 2A, inlet manifold 48 connects to pipe 49 such that water in manifold 48 is distributed to pipe 49. Pipe 49 can be lined with a PVC tube extending a considerable distance down pipe 49, potentially miles.

Flow guide 54 can be made on-site from PVC sheet 51 on roll 50. PVC sheet 51 is fed through clamp/seal 47 around spreader 52. The dimensions of the sheet and spreader are such that the sheet can form a circle with sufficient overlap to be welded by spot welder 53, thus forming cylindrical flow guide 54. Flow guide 54 can be impressed with a series of ribs 56 and grooves 55 generally oriented parallel to the direction of pipe 49. Water flowing from manifold 48 into pipe 49 coupled with an appropriate feed rate of PVC sheet from roll 50 through clamp/seal 47 will allow the flow guide 54 to fit within pipe 49 much like a wind sock. Riblets 56 will reduce friction along the walls of pipe 49, thus increasing the amount of water which can be carried in pipe 49 during turbulent flow.

The flow guide/pipe system can be improved by channeling or pumping water into the space 55 between the wall of pipe 49 and flow guide 54, forming a cushion between the two. Space 55 between flow guide 54 and pipe 49 can be rather small. In a preferred implementation, that spacing is a fraction of an inch in a pipe 49 with inside diameter in excess of one foot, even many feet. Water flowing inside flow guide 54 will press against flow guide 54, thereby exerting pressure against water in space 55 and finally against pipe 49. The fluid in channel 55 acts as a cushion, thereby protecting flow guide 54 and preventing flow guide 54 from contacting the walls of pipe 49.

The action of flow guide 54 can be improved still further by introducing friction reducing material through an appropriate mechanism. For example, one skilled in the art can construct an annular feed ring 60 with feed channels 61 fitted to deliver desired amounts of friction reducing material into channel 55. This can produce an increased pressure in 55 relative to the pressure in the main flow channel 56, further maintaining channel 55. Flow guide 54 can be fitted with bleed holes 57 to allow some portion of the material in channel 55 to leak into channel 56. This can introduce local high concentrations of friction reducing material directly into the grooves of flow guide 54. The action of friction reducing material and the riblets is additive, resulting in a still greater reduction in friction along the pipe walls, allowing a still greater flow of water through pipe 49 during turbulent flow.

A general description of the system and method of using the present invention as well as a preferred embodiment of the present invention has been set forth above. One skilled in the art will recognize and be able to practice additional variations in the methods described and variations on the device described which fall within the teachings of this invention.

EXAMPLE 1

Solution Polymarization

Acrylamide is easily polymerized in the presence of free radicals. Among the initiators commonly used are peroxides, redox pairs, azo compounds, photochemical systems, perborates, percarbonates, and radiation. The polymerization is preferably carried out in aqueous solution. Molecular weight may be controlled by the use of chain transfer agents such as the water-soluble lower alcohols (methanol, ethanol and isopropanol) or thiols. Large amounts of initiator and high temperatures also produce low molecular weight polymer. The polymerization of acrylamide is most frequently conducted in an inert atmosphere of nitrogen or carbon dioxide, and at a pH in the range of 3 to 8.

When acrylamide is polymerized at a pH above 9, some of the amide groups may be hydrolyzed. At a pH of 2.5 or below, imidization occurs which will lead to the formation of crosslinked and relatively insoluble polymer. A typical example using isopropyl alcohol as the chain transfer agent to produce a low molecular weight polymer is the following:

| | |
|---|---|
| Acrylamide | 100 parts |
| Demineralized Water | 800 parts |
| Isopropyl Alcohol | 15.0 parts |
| Potassium Persulfate | 0.185 parts |

The monomer and water are warmed to 68° C. under a rapid stream of carbon dioxide. The isopropyl alcohol and the catalyst are then added, causing the reaction temperature to rise to 75°-80° C. This temperature range is then maintained for two hours. The reaction product is a clear, colorless solution having a viscosity in the vicinity of 3,500 cps. at 25° C.

The following example is a typical procedure for the preparation of very high molecular weight polyacrylamides.

| | |
|---|---|
| Acrylamide | 100 parts |
| Demineralized, Oxygen-Free Water | 900 parts |
| Ammonium Persulfate | 0.04 parts |
| 3,3',3''-Nitrilo-trispropionamide | 0.06 parts |

The water is freed from oxygen by boiling for ten minutes or longer and cooling under an atmosphere of nitrogen. It is then used to prepare an acrylamide solution containing 100 parts acrylamide and 900 parts of water. This solution is then charged into a reactor containing a submerged inlet for the injection of nitrogen and surrounded by a cooling bath capable of maintaining the reaction temperature at 20°±1° C. The catalysts are then added and the solution is mixed by vigorous injection of nitrogen. Polymerization begins within a few minutes and is continued under a nitrogen blanket for about eight hours, when it is usually about 98% complete. The final product is a tough, rubbery jel which may conveniently be put into solution by mixing with water or converted to a powder by precipitation. The intrinsic viscosities of polyacrylamide prepared by this procedure are within the range of about 18-30 and therefore their molecular weights range above 12 million. An apparatus and procedure have been described for the continuous laboratory-scale polymerization of acrylamide.

What is claimed is:

1. In a system of fluid transport, comprising a fluid source, a fluid reservoir, a fluid transport connecting said source and said reservoir, and an outlet of said reservoir, the improvement comprising:

a fluid reservoir containing a fluid, means for monitoring the concentration of a friction reducing material in said reservoir and means for maintaining said concentration below a preselected maximum, means for monitoring the concentration of said friction reducing material in said fluid transport and maintaing said concentration below a preselected maximum, means for monitoring the concentration of said friction reducing material at said outlet of said reservoir and maintaining said concentration below a preselected maximum, and means for adding friction reducing material to said fluid transport when said reservoir is less than full and said fluid transport could handle a greater throughput, i.e. there is an excess of fluid available at said fluid source and the throughput in said fluid transport limits the amont of fluid which can be transported from said source to said reservoir.

2. The system of claim 1 wherein said concentration of a friction reducing material is tolerable by people, fish, and water life.

3. The system of claim 1 further comprising means to control addition of friction reducing material in time and in concentration whereby the maximum concentration in said system can be controlled.

4. The system of claim 1 further comprising distributed sensing and means to share information among a plurality of sensors.

5. The system of claim 1 further comprising means for determining the concentration of friction reducing material and reducing said concentration to no more than a preselected level.

6. The system of claim 5 further comprising means for reducing said concentration of friction reducing material by shearing action.

7. The system of claim 5 further comprising means for reducing said concentration of friction reducing material by gravimetric means, including centrifugation.

8. The system of claim 5 further comprising means for reducing said concentration of friction reducing material by photolysis, wherein said friction reducing material is activated by light or a secondary compound connected to or acting on said friction reducing material is activated by light.

9. The system of claim 1 further comprising means for reducing said concentration of friction reducing material uses a biological agent to degrade or consume said friction reducing material.

10. The system of claim 1 wherein said friction reducing material has a ratio of length to width in excess of 25, whereby the fluid can flow with reduced friction in a turbulent flow condition.

11. The friction reducing material of claim 1 wherein said friction reducing material is fit for human consumption.

12. The friction reducing material of claim 10 wherein said fluid is water.

13. The friction reducing material of claim 10 wherein said material is partially hydrolyzed polyacrylamide.

14. The friction reducing material of claim 10 wherein said material is selected from the group consisting of guar gum and carrageenan.

15. In a system of fluid transport, comprising a fluid source and a fluid transport connected to said source, the improvement comprising:

a fluid source containing a fluid and a friction reducing material, means for monitoring the concentration of a friction reducing material in said source and means for maintaining said concentration below a preselected maximum, means for monitoring the concentration of said friction reducing material in said fluid transport and maintaining said concentration below a preselected maximum, and means for adding friction reducing material to said fluid transport when said fluid transport could handle a greater throughput of fluid.

16. The system of claim 15 further comprising means to control addition of friction reducing material in time and in concentration whereby the maximum concentration in said system can be controlled.

17. The system of claim 15 further comprising means for determining the concentration of friction reducing material and reducing said concentration to no more than a preselected level.

18. The system of claim 17 further comprising means for reducing said concentration of friction reducing material, said means selected from the group consisting of shearing action, gravimetric means, including centrifugation, and photolysis, wherein said friction reducing material is activated by light or a secondary compound connected to or acting on said friction reducing material is activated by light.

19. The system of claim 15 further comprising means for reducing said concentration of friction reducing material uses a biological agent to degrade or consume said friction reducing material.

* * * * *